United States Patent [19]

Hollander

[11] 4,012,550

[45] Mar. 15, 1977

[54] TIERED INTERLINING FOR GARMENTS

[76] Inventor: Frank Gabriel Hollander, 77-14 113th St., Forest Hills, N.Y. 11375

[22] Filed: Nov. 14, 1975

[21] Appl. No.: 631,825

[52] U.S. Cl. ..... 428/190; 2/401; 2/272

[51] Int. Cl.[2] ..... A41B 9/02

[58] Field of Search ..... 2/272, 97, 243 A, 255; 428/157, 172, 190, 198; 427/261, 156

[56] References Cited

UNITED STATES PATENTS

| | | | |
|---|---|---|---|
| 1,683,226 | 9/1928 | Zuck | 2/272 |
| 2,579,894 | 12/1951 | Yaghubian | 2/225 |
| 2,713,685 | 7/1955 | Nachem | 2/93 |
| 3,138,514 | 6/1964 | Florio | 428/198 |
| 3,916,447 | 11/1975 | Thompson | 2/243 A |

*Primary Examiner*—Werner H. Schroeder
*Assistant Examiner*—Doris L. Troutman
*Attorney, Agent, or Firm*—William R. Liberman

[57] ABSTRACT

An outer garment is provided with an interlining of graduated thicknesses, thickest around the upper chest and shoulder areas, thinner around the collar and lapel areas, a little less thick in area from below the buttons to about the lapel area, and least thick from below the button area to the lower edge of the garment. A single layer of interlining material extends the full length of the garment from the bottom edge to the lapel and collar areas; a second layer is superposed on the first layer extending from just below the button area to the collar; and a third layer is superposed upon the previous two layers but extending from above the area of the buttons through and past the lapels and around to the shoulder. The two or more layers or thicknesses are secured together along the overlapped portions thereof and at points on lines spaced therebetween.

3 Claims, 3 Drawing Figures

FIG. 1
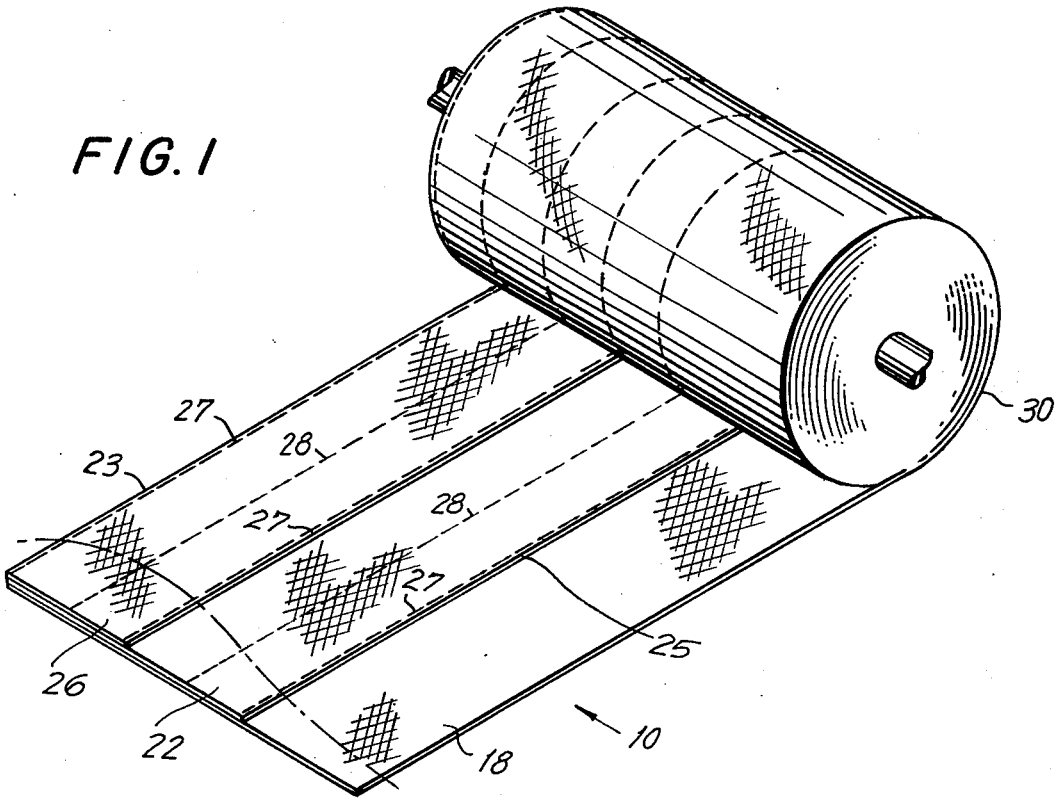
FIG. 2
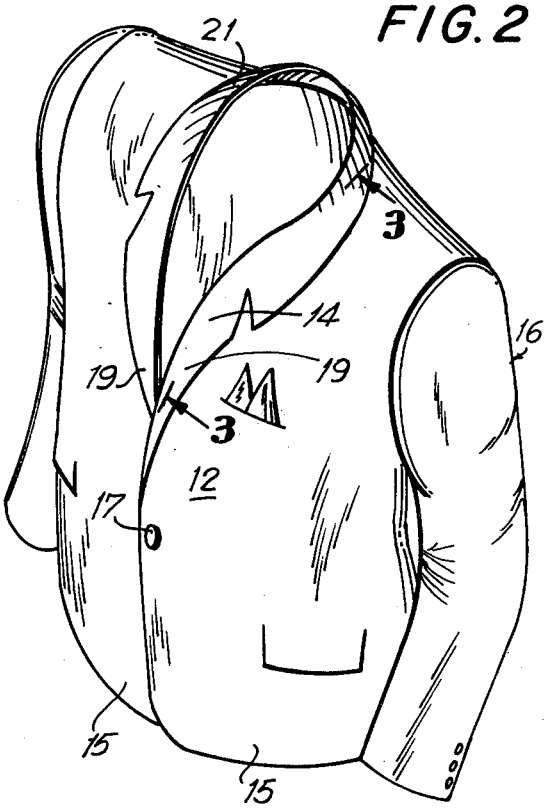
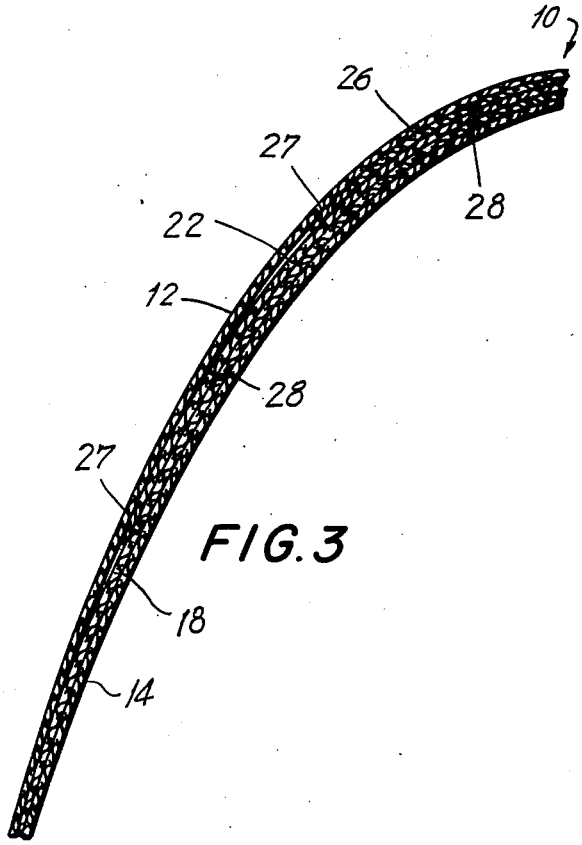
FIG. 3

TIERED INTERLINING FOR GARMENTS

BACKGROUND OF THE INVENTION

Presently, the interlining of a garment such as a jacket or overcoat for men and/or women is necessarily cut to shape from a supply sheet or roll. Since it is customary and highly desirably that the interlining be of graduated thickness increasing from the bottom of the garment to the shoulder area, the interlining pieces must be separately cut by hand and then individually bound together to build up the graduated thickness desired for the length of the garment. These hand operations require the use of skilled and hence expensive labor, and these highly intricate and time-consuming steps in the process of manufacture greatly increase the cost of the garment. The present invention is provided to eliminate the separate hand operations required for the cutting and joining of each of the interlining thicknesses.

SUMMARY OF THE INVENTION

It is therefore the principal object of the present invention to provide an outer garment supporting interlining, the lining being of multi-layered construction, and with all thicknesses cut and shaped simultaneously.

It is a further object of the present invention to provide a garment interlining supporting material of graduated thicknesses across the width thereof.

It is further object of the present invention to provide an interlining for outer garments formed of a plurality of thicknesses, thinnest at the bottom of the garment and thickest at the top along the shoulder area.

Other and further objects will in part be apparent from the following description of the illustrative embodiment, and others will in part be specifically pointed out hereinbelow.

BRIEF DESCRIPTION OF THE DRAWINGS

FIG. 1 shows the supporting material in a continuous roll.

FIG. 2 shows a garment with the supporting material on the inside thereof.

FIG. 3 is a cross sectional view of the supporting material and the garment taken along the line 3—3 of FIG. 2.

PREFERRED EMBODIMENT OF THE PRESENT INVENTION

In outer garments such as jackets, top coats and overcoats for men and for women, the design is such that the front wings which include buttonholes for closure, lapels and collars be so formed that the collar and lapels which ordinarily are folded over from the wings be made sufficiently rigid so as to retain the shape in which that garment is originally set and pressed. Such construction required an interlining material, and the present invention relates to the formation of such interlining material and its preparation. The interlining material is usually permanently located in the pocket formed between the outer and inner layers of the fabric forming the garment.

Referring to the annexed drawing, the interlining 10 is located between the outer fabric 12 and the inner facing 14 along the front panels 15, 15 of the coat. The area between the hem or bottom of the garment and the button 17 needs a minimum amount of interlining since such wing portions of the garment ordinarily lie flatly anyway. However, the area between button 17 and lapel 19 requires more body and hence more interlining since there is much more wear in the buttoning and unbuttoning of the garment. The area between the lower portion of the lapel and around the collar 21 requires the greatest thickness since the collar and lapels are bent back to present the underside of the fabric to view in the areas between the numerals 19, 21, 19.

The interlining is formed of a number of thicknesses of suitable material. The base or main body portion of the interlining is indicated by reference numeral 18. The underside of the base portion 18 may be treated with a bonding substance such as a fusible resin. The bonding substance can be applied as desired or as convenient, depending upon the material of which the interlining is made and the material to which it is to be adhered. A second layer or thickness of interlining material 22 extends from one end 23 of base layer 18 about two-thirds of the width of layer 18, as indicated at 25. A third layer or thickness 26 may be provided superposed on the other two extending from edge 23 across approximately one-half the width of the second layer 22. Layers 22 and 26 can be secured to each other by lines of stitching or heat sealing 27 extending lengthwise of the material at the respective edges thereof and, additionally, by lines as 28 extending lengthwise of each of the separate superposed layers 22, 26. As will be readily apparent, when it is desired to form an interlining for any particular garment, once the shape is determined, a suitable portion of the superposed layers can be drawn off a supply roll 30 thereof and in a single operation all three components of the interliner may be cut and shaped as desired. The upper surfaces of the three panels or thicknesses of interlining may also be treated if desired with a suitable bonding material so that once the interlining is inserted between the inner and outer layers 12, 14 of the garment, it can be heat sealed permanently in the desired position, and when the collar portion 21 is bent back as shown in FIG. 2 of the drawing, a permanent set can be inserted thereto.

It is, of course, possible and within the scope of this invention to provide an interlining of more than three graduated thicknesses, as in a garment which has more than three areas or regions which require different thicknesses. These additional layers may be used to provide for additional shaping of the garment.

I claim:

1. A roll of shape holding garment interliner material comprising a base layer and a plurality of layers of successively shorter lengths from side to side of the base layer, said plurality to be disposed atop the base layer, the upper edges of all layers being secured in registry, the lower edges thereof being successively spaced upwardly of the lower edge of the base and of the next lower layer and secured thereto along the marginal side edge of each of said plurality of layers.

2. An interliner as in claim 1, wherein the upper edges of the successive layers extend along one side of the roll, and the lines of securement extend lengthwise of the interliner as it is taken off the roll.

3. The interliner according to claim 1, wherein each successive layer is attached to the layer beneath at uniformly spaced points transversely of the length of the layer beneath it.

* * * * *